US008140309B2

(12) United States Patent
Manglik et al.

(10) Patent No.: US 8,140,309 B2
(45) Date of Patent: Mar. 20, 2012

(54) METHOD OF PREDICTING THE DYNAMIC BEHAVIOR OF WATER TABLE IN AN ANISOTROPIC UNCONFINED AQUIFER HAVING A GENERAL TIME-VARYING RECHARGE RATE FROM MULTIPLE RECTANGULAR RECHARGE BASINS

(75) Inventors: Ajai Manglik, Andhra Pradesh (IN); Shivendra Nath Rai, Andhra Pradesh (IN)

(73) Assignee: Council of Scientific & Industrial Research, Anusandhan Bhawan, Rafi Marg New Delhi (IN)

( * ) Notice: Subject to any disclaimer, the term of this patent is extended or adjusted under 35 U.S.C. 154(b) by 1115 days.

(21) Appl. No.: 11/947,340

(22) Filed: Nov. 29, 2007

(65) Prior Publication Data

US 2009/0024369 A1 Jan. 22, 2009

(30) Foreign Application Priority Data

Jul. 18, 2007 (IN) ..... 1522/DEL/2007

(51) Int. Cl.
*G06G 7/58* (2006.01)

(52) U.S. Cl. ..... 703/10

(58) Field of Classification Search ..... 703/10; 405/36–51

See application file for complete search history.

(56) References Cited

U.S. PATENT DOCUMENTS 7,191,071 B2 * 3/2007 Kfoury et al. ..... 702/32
2005/0229680 A1 * 10/2005 Kfoury et al. ..... 73/38

OTHER PUBLICATIONS

S.N. Rai, R.N. Singh, "An Analytical Solution for Water-table Fluctuation in a Finite Aquifer due to Transient Recharge from a Strip Basin" Water resources Management, 1995, pp. 27-37.*

Shivendra Nath Rai, Rishi Narain Singh, "On the Predictability of the Water-Table Variation in a Ditch-Drainage System" Water Resources Management, 1988, pp. 289-298.*

* cited by examiner

*Primary Examiner* — Dwin M Craig
(74) *Attorney, Agent, or Firm* — Luedeka Neely Group, P.C.

(57) ABSTRACT

The present invention relates to development of a method of predicting the dynamic behavior of water table in an anisotropic unconfined aquifer having a general time-varying recharge rate from multiple rectangular recharge basins. Each basin can have a different dimension and nature of rate of recharge. Aquifer can have prescribed head, zero flux, or a combination of both types of boundary conditions.

10 Claims, 6 Drawing Sheets

METHOD OF PREDICTING THE DYNAMIC BEHAVIOR OF WATER TABLE IN AN ANISOTROPIC UNCONFINED AQUIFER HAVING A GENERAL TIME-VARYING RECHARGE RATE FROM MULTIPLE RECTANGULAR RECHARGE BASINS

TECHNICAL FIELD

The present invention relates a method of predicting the dynamic behavior of water table in an anisotropic unconfined aquifer having a general time-varying recharge rate from multiple rectangular recharge basins.

BACKGROUND AND SUMMARY

Mathematical modeling tools are an integral part of any groundwater management system. These are required to predict spatio-temporal variations of groundwater level in an aquifer system in response to recharge and pumping. These modeling tools fall under two categories: (i) analytical and (ii) numerical. While numerical methods are able to incorporate aquifer heterogeneities in the groundwater management system, analytical methods give exact solutions of groundwater flow problems having simple aquifer systems and are fast in terms of computation time.

In an article, Baumann (1952) derived analytical solution to describe growth of the groundwater mound in sloping aquifers receiving vertical recharge. In another article, Glover (1960) developed analytical solution for the growth of water table in an infinite unconfined aquifer induced by recharge from a circular area. In another work, Hantush (1967) developed solutions for the growth and decay of water table in infinite unconfined aquifers in response to recharge from circular and rectangular recharge basins. In yet another article, Warner et al. (1989) reviewed the performance of analytical solutions developed by Baumann (1952), Glover (1960), Hantush (1967), Hunt (1971), and Rao and Sarma (1981). These analytical solutions are based on the assumption of constant rate of recharge and were developed for a single recharge basin. Zomorodi (1991) used observed water table fluctuation data to show that the analytical solution of Dagan (1966) based on the assumption of constant rate of recharge lead to erroneous results in the case of time varying recharge rate.

In one article, Dagan (1964) derived analytical solution to describe water table fluctuations in a drainage system receiving step-wise time varying recharge. In another article, Singh and Jacob (1977) developed analytical solutions for groundwater flow in an unconfined aquifer for constant and variable rates of recharge and withdrawal. They approximated variable rates of recharge and withdrawal by periodic step functions. In another article, Rai et al. (1994) developed analytical solution for exponential recharge rate from a single basin. These analytical solutions were developed for a single recharge basin.

In an article, Manglik and Rai (2000) developed analytical solution to model water table fluctuations in an isotropic unconfined aquifer in response to time varying recharge from multiple rectangular basins. This solution incorporates prescribed head boundary conditions and approximates wells as rectangular discharge basins of very small dimension. In yet another article, Manglik et al. (2004) developed analytical solution to describe water table variation in the presence of time varying recharge and pumping from any given number of recharge basins with the prescribed zero flux boundary conditions. These solutions were developed under the assumption of isotropic aquifer. Present invention describes a more generalized analytical solution for an anisotropic unconfined aquifer.

The main object of the present invention is to provide a method of predicting the dynamic behavior of water table in an anisotropic unconfined aquifer having a general time-varying recharge rate from multiple rectangular recharge basins.

Another object of the present invention is to provide analytical method for validation of numerical schemes which are used to model real field problems of groundwater flow.

Yet another object of the present invention is to provide analytical method for sensitivity analysis of various controlling parameters such as physical properties of aquifer, nature of recharge rate, and distribution of recharge basins within the aquifer.

A further object of the invention is to provide a digital implementation of the analytical method for modeling of the groundwater flow in an anisotropic unconfined aquifer for a general time-varying rate of recharge from multiple rectangular recharge basins.

The present invention provides a method of predicting the dynamic behavior of water table in an anisotropic unconfined aquifer having a general time-varying recharge rate from multiple rectangular recharge basins, the said method comprising the steps of setting up of a second order diffusion equation describing groundwater flow in an anisotropic unconfined aquifer having finite length and width along X and Y directions, respectively, prescribing different combinations of Dirichlet (prescribed head) and Neumann (zero flux) conditions at the boundaries of the aquifer, prescribing the locations and dimensions of various rectangular recharge basins located within the aquifer, prescribing a general time-varying recharge function as the source term in the diffusion equation to describe rates of recharge for each of the recharge basins, solving the above said system of equations by using finite Fourier transform method to obtain analytical solution for the prediction of spatial and temporal variation of water table and finally, digitally implementing the analytical solution for prediction of dynamic behavior of water table in response to applied time varying recharge

DETAILED DESCRIPTION OF THE INVENTION

Figure 1:
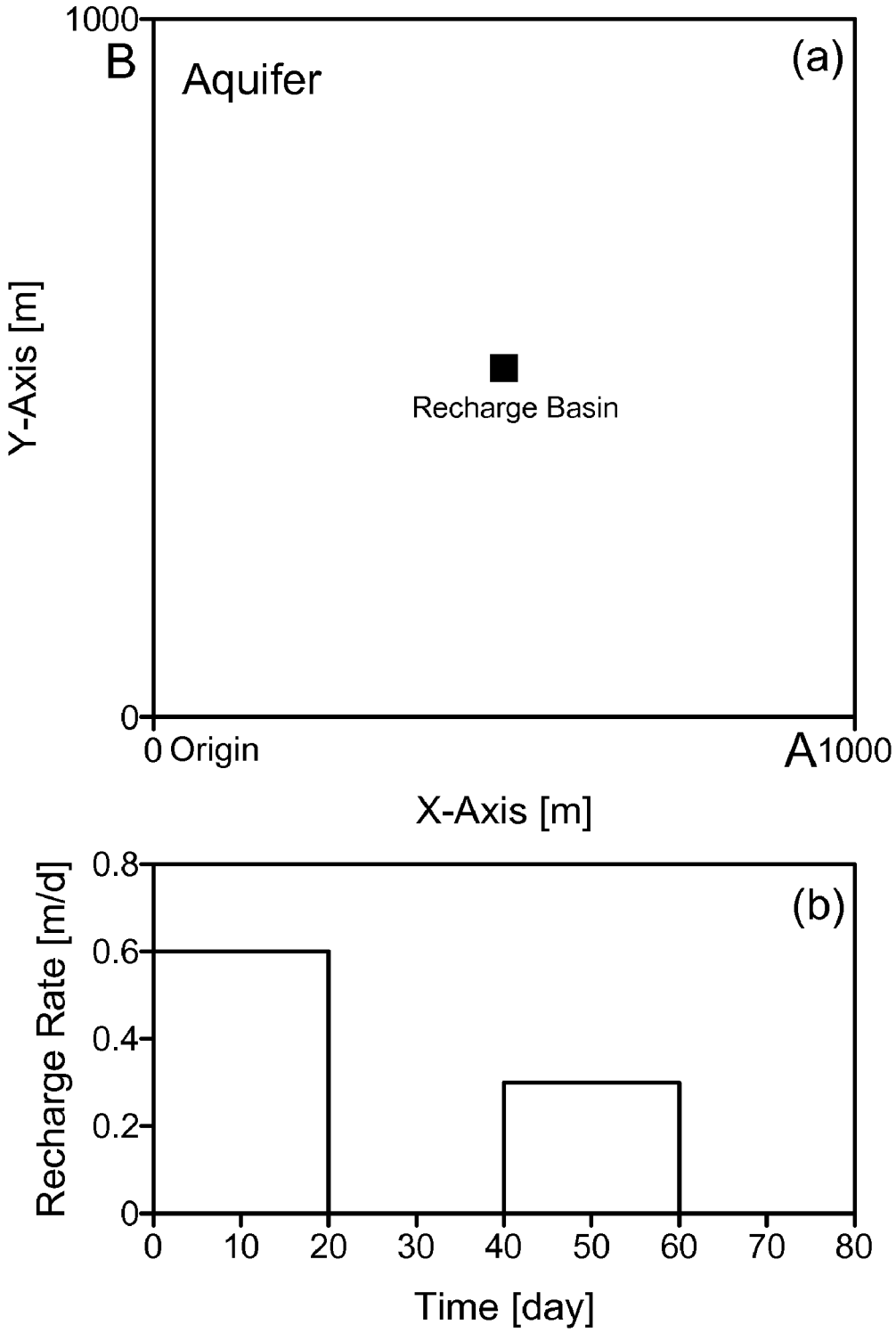
FIG. 1 represents (a) a plan view of an anisotropic unconfined aquifer having one rectangular recharge basin and (b) time varying rate of recharge applied through the basin.

Accordingly, the present invention provides a method of predicting the dynamic behavior of water table in an anisotropic unconfined aquifer having a general time-varying recharge rate from multiple rectangular recharge basins, the said method comprising the steps of:

(a) setting up of a second order diffusion equation describing groundwater flow in an anisotropic unconfined aquifer having finite length and width along X and Y directions, respectively (b) prescribing different combinations of Dirichlet (prescribed head) and Neumann (zero flux) conditions at the boundaries of the aquifer (c) prescribing the locations and dimensions of various rectangular recharge basins located within the aquifer (d) prescribing a general time-varying recharge function as the source term in the diffusion equation to describe rates of recharge for each of the recharge basins (e) solving the above system of equations (a to d) by using finite Fourier transform method to obtain analytical solution for the prediction of spatial and temporal variation of water table (f) implementing digitally the analytical solution as obtained in step (e) for prediction of dynamic behavior of water table in response to applied time varying recharge.

In an embodiment of the present invention, the aquifer is a porous medium having anisotropic hydraulic conductivity.

In another embodiment of the present invention, the aquifer has a finite length and width along X and Y directions, respectively.

In yet another embodiment of the present invention, the coefficient of anisotropy is taken as the ratio of hydraulic conductivities along Y and X directions.

In still another embodiment of the present invention, the three different combinations of prescribed head and zero flux conditions at the boundaries of the aquifer are considered.

In a further embodiment of the present invention, all the recharge basins can be arbitrarily located within the aquifer.

In yet another embodiment of the present invention, the general time-varying rate of recharge is represented by a series of linear elements closely approximating the actual rate of recharge.

In still another embodiment of the present invention, each recharge basin can have different time-varying rate of recharge.

In yet another embodiment of the present invention, the analytical solution is obtained by using finite Fourier transform method.

In another embodiment of the present invention, the water table height at a given time and at a given location can be computed analytically.

In yet another embodiment of the present invention, the digitally implemented method invokes the user to specify two file names, one for input and the other for output.

In yet another embodiment of the present invention, the first data card consists of model number in character format.

In another embodiment of the present invention, the second data card consists of length and width of aquifer in SI units and in real format.

In still another embodiment of the present invention, the third data card consists of number of Fourier coefficients in X and Y directions.

In still another embodiment of the present invention, the fourth data card consists of hydraulic conductivity, specific yield, and initial water table height.

In yet another embodiment of the present invention, the fifth data card consists of coefficient of anisotropy.

In another embodiment of the present invention, the sixth data card consists of number of time, X location, and Y location values.

In still another embodiment of the present invention, the seventh data card consists of a comment card followed by values of time at which computation is required.

In yet another embodiment of the present invention, the eighth data card consists of comment card followed by values of X co-ordinates at which computation is required.

In yet another embodiment of the present invention, the ninth data card consists of comment card followed by values of Y co-ordinates at which computation is required.

In another embodiment of the present invention, the tenth data card consists of number of recharge basins and maximum number of linear elements required to represent time varying recharge rate.

In still another embodiment of the present invention, the eleventh data card consists of information about parameters of recharge basins.

In another embodiment of the present invention, the twelfth data card consists of option for the type of boundary conditions.

In still another embodiment of the present invention, the water table variation is the difference between the actual value of water table at a given time and location and the initial water table height, both measured from the base of the aquifer.

The present invention describes development of analytical solution and associated digital implementation for the prediction of water table variation in an anisotropic unconfined aquifer which receives time varying recharge from multiple rectangular recharge basins.

Accordingly, an anisotropic unconfined aquifer has a length and width of A and B along X and Y directions, respectively, as shown in FIG. 1(*a*). The origin of the coordinate system coincides with the lower left corner of the aquifer. Any number of recharge basins, each of which can have a different time varying recharge pattern, can be considered within the aquifer. For N such recharge basins, the coordinates of the lower left and upper right corners of the $i^{th}$ basin are given as $(x_{i1}, y_{i1})$ and $(x_{i2}, y_{i2})$, respectively.

The flow of groundwater in the aquifer can be expressed under Dupuit approximation by the following Boussinesq equation:

$$\frac{\partial^2 H}{\partial x^2} + \beta \frac{\partial^2 H}{\partial y^2} + \frac{2}{K_x} P(x, y, t) = \frac{1}{a} \frac{\partial H}{\partial t} \qquad \text{Eq}^n.\ \text{I}$$

wherein;

$H = h^2 - h_o^2$ $a = K_x^{-} h/S$ $\beta$=coefficient of anisotropy ($K_y/K_x$)

h=variable water table height $h_o$=initial water table height $\bar{h}$=weight mean of the depth of saturation
Kx=hydraulic conductivity in X direction
Ky=Hydraulic conductivity in Y direction
S=Specific yield
P=Recharge rate
$x_1y_1$=lower left corner of recharge basin
$x_2y_2$=upper right corner of recharge basin
A=Length of aquifer
B=width of aquifer
N=Number of recharge basin
Pi(t)=recharge rate of $i^{th}$ basin
Ha(x)=Unit step function
m & n=number of Fourier coefficient
r=Slope
c=Intercept
t=time The initial condition is represented by the following equation:

$$H(x,y,0)=0, \qquad \text{Eq}^n.\ \text{II}$$

Boundary conditions depend on the choice of the problem. In the case of prescribed head condition (Case-I) these are given as:

$$H(0,y,t)=H(A,y,t)=0,\ 0\leqq y\leqq B$$

$$H(x,0,t)=H(x,B,t)=0,\ 0\leqq x\leqq A \qquad \text{Eq}^n.\ \text{III}$$

For zero flux case (Case-II) these are given as:

$$\frac{\partial H}{\partial x}(0,y,t)=\frac{\partial H}{\partial x}(A,y,t)=0,\quad 0\le y\le B \qquad \text{Eq}^n.\ \text{IV}$$
$$\frac{\partial H}{\partial y}(x,0,y)=\frac{\partial H}{\partial y}(x,B,t)=0,\quad 0\le x\le A$$

and for the mixed prescribed head and zero flux case (Case-III) the boundary conditions are:

$$\frac{\partial H}{\partial x}(0,y,t)=H(A,y,t)=0,\quad 0\le y\le B \qquad \text{Eq}^n.\ \text{V}$$
$$\frac{\partial H}{\partial y}(x,0,t)=H(x,B,t)=0,\quad 0\le x\le A$$

The time varying recharge rate P(x,y,t) in Eq.I is the sum of recharge rates of all the basins. This is given as:

$$P(x,y,t)= \qquad \text{Eq}^n.\ \text{VI}$$
$$\sum_{i=1}^{N} p_i(t)[H_a(x-x_{i1})-H_a(x-x_{i2})]\cdot[H_a(y-y_{i1})-H_a(y-y_{i2})]$$

where; $p_i(t)$=recharge rate of $i^{th}$ basin, N=Total number of basins, $H_a(x)$=unit step function. $p_i(t)$ is approximated by a series of line elements given by:

$$p_i(t)=\begin{cases} r_{ij}t+c_{ij}, & t_{ij}\le t\le t_{i,j+1} \\ r_{ik}t+c_{ik}, & t\ge t_k \end{cases} \qquad \text{Eq}^n.\ \text{VII}$$

where $r_{ij}$ and $c_{ij}$ are the slope and intercept of the $j^{th}$ linear element of the $i^{th}$ basin.

Above equations are solved by using finite Fourier transform. Analytical solutions for the above three cases are obtained as:

Case-I: Prescribed Head Conditions

Water table is known at the boundaries. The boundary condition depends on the choice of the problem. In this case the problem defined by Equation (I-III) is solved by using finite Fourier sine transform. The solution is given as:

$$H(x,y,t)=\frac{4}{AB}\sum_{m=1}^{\infty}\sum_{n=1}^{\infty}\overline{H}(m,n,t)\sin\left(\frac{m\pi x}{A}\right)\sin\left(\frac{n\pi y}{B}\right) \qquad \text{Eq}^n.\ \text{VIII}$$

where $$\overline{H}(m,n,t)=\frac{2a}{K_x}\left[\sum_{i=1}^{N} g_i(m,n)\left\{\sum_{j=1}^{k-1} S_{ij}-S_{ik}\right\}\right] \qquad \text{Eq}^n.\ \text{IX}$$

$$g_i(m,n)= \qquad \text{Eq. X}$$
$$\frac{AB}{mn\pi^2}\left[\cos\left(\frac{m\pi x_{i2}}{A}\right)-\cos\left(\frac{m\pi x_{i1}}{A}\right)\right]\cdot\left[\cos\left(\frac{n\pi y_{i2}}{B}\right)-\cos\left(\frac{n\pi y_{i1}}{B}\right)\right]$$

$$S_{ij}=\frac{r_{ij}}{\alpha}[t_{i,j+1}\exp\{-\alpha(t-t_{i,j+1})\}-t_{ij}\exp\{-\alpha(t-t_{ij})\}]- \qquad \text{Eq. XI}$$
$$\left(\frac{r_{ij}}{\alpha^2}-\frac{c_{ij}}{\alpha}\right)[\exp\{-\alpha(t-t_{i,j+1})\}-\exp\{-\alpha(t-t_{ij})\}]$$

$$S_{ik}= \qquad \text{Eq. XII}$$
$$\frac{r_{ik}}{\alpha}[t-t_{ik}\exp\{-\alpha(t-t_{ik})\}]-\left(\frac{r_{ik}}{\alpha^2}-\frac{c_{ik}}{\alpha}\right)[1-\exp\{-\alpha(t-t_{ik})\}]$$

$$\text{Wherein, } \alpha=a\pi^2\left[\left(\frac{m}{A}\right)^2+\beta\left(\frac{n}{B}\right)^2\right] \qquad \text{Eq}^n\ \text{XIV}$$

Case-II: Zero Flux Conditions

In this case, no flow of water across the boundaries is allowed. This problem is defined by Eq. (I, II, and IV) and is solved by using finite Fourier cosine transform and the solution is given by:

$$H(x,y,t)=\frac{1}{AB}\overline{H}(0,0,t)+ \qquad \text{Eq}^n.\ \text{XV}$$
$$\frac{2}{AB}\sum_{m=1}^{\infty}\overline{H}(m,0,t)\cos\left(\frac{m\pi x}{A}\right)+\frac{2}{AB}\sum_{n=1}^{\infty}\overline{H}(0,n,t)\cos\left(\frac{n\pi y}{B}\right)+$$
$$\frac{4}{AB}\sum_{m=1}^{\infty}\sum_{n=1}^{\infty}\overline{H}(m,n,t)\cos\left(\frac{m\pi x}{A}\right)\cos\left(\frac{n\pi y}{B}\right)$$

where $\overline{H}(m,n,t)$ is Fourier Transform of H(x, y, t) and is given by Eq. IX except that $g_i(m,n)$ is now defined as:

$$g_i(m,n)=\left[x_{i2}sinc\left(\frac{m\pi x_{i2}}{A}\right)-x_{i1}sinc\left(\frac{m\pi x_{i1}}{A}\right)\right]\cdot \qquad \text{Eq}^n.\ \text{XVI}$$
$$\left[y_{i2}sinc\left(\frac{n\pi y_{i2}}{B}\right)-y_{i1}sinc\left(\frac{n\pi y_{i1}}{B}\right)\right]$$

where $$\sin c(x)=\sin(x)/x \qquad \text{Eq}^n.\ \text{XVII}$$

Case-III: Mixed Boundary Conditions

In this case, a combination of above two boundary conditions is mentioned in a single problem. The groundwater flow problem is represented by $\text{Eq}^n$. (I, II, and V). The solution is obtained by using extended finite Fourier cosine transform and is given as:

$$H(x, y, t) = \frac{4}{AB}\sum_{m=0}^{\infty}\sum_{n=0}^{\infty}\overline{H}(m, n, t)\cos\left(\frac{(2m+1)\pi x}{2A}\right)\cos\left(\frac{(2n+1)\pi y}{2B}\right) \quad \text{Eq}^n.\ \text{XVIII}$$

where $\overline{H}(m,n,t)$ is given by Eq.IX with $g_i(m,n)$ and $\alpha$ defined as following:

$$g_i(m, n) = \left[x_{i2}sinc\left(\frac{(2m+1)\pi x_{i2}}{2A}\right) - x_{i1}sinc\left(\frac{(2m+1)\pi x_{i1}}{2A}\right)\right]\cdot\left[y_{i2}sinc\left(\frac{(2n+1)\pi y_{i2}}{2B}\right) - y_{i1}sinc\left(\frac{(2n+1)\pi y_{i1}}{2B}\right)\right] \quad \text{Eq}^n.\ \text{XIX}$$

$$\alpha = \frac{a\pi^2}{4}\left[\left(\frac{2m+1}{A}\right)^2 + \beta\left(\frac{2n+1}{B}\right)^2\right] \quad \text{Eq}^n.\ \text{XX}$$

These analytical solutions are digitally implemented. The source code can be used for implementing the given analytical solution for groundwater flow modeling in accordance with the present invention.

The following examples are given by way of illustration and therefore should not be construed to limit the scope of the present invention.

Example-1

First example illustrates a case of water table variation in response to step-wise constant recharge rate from a rectangular basin located approximately at the center of an anisotropic unconfined aquifer. Prescribed head boundary conditions (Case-I) are used in this example. FIG. 1 (a) shows a plain view of the aquifer and the recharge basin. FIG. 1 (b) shows the variation of recharge rate with time. It indicates that two cycles of recharging are separated by a period of no recharge during $20^{th}$ to $40^{th}$ day. Other input parameters are:

| | | |
|---|---|---|
| Length of aquifer | A | 1000 m |
| Width of aquifer | B | 1000 m |
| Number of Fourier coefficients | m, n | 100 |
| Hydraulic conductivity in X direction | $K_x$ | 4.0 m/d |
| Specific yield | S | 0.2 |
| Initial water table height | $h_0$ | 10 m |
| Anisotropy coefficient | β | 3.0 |
| Lower left corner of recharge basin | $(x_1, y_1)$ | (480, 480) |
| Upper right corner of recharge basin | $(x_2, y_2)$ | (520, 520) |

Figure 2:
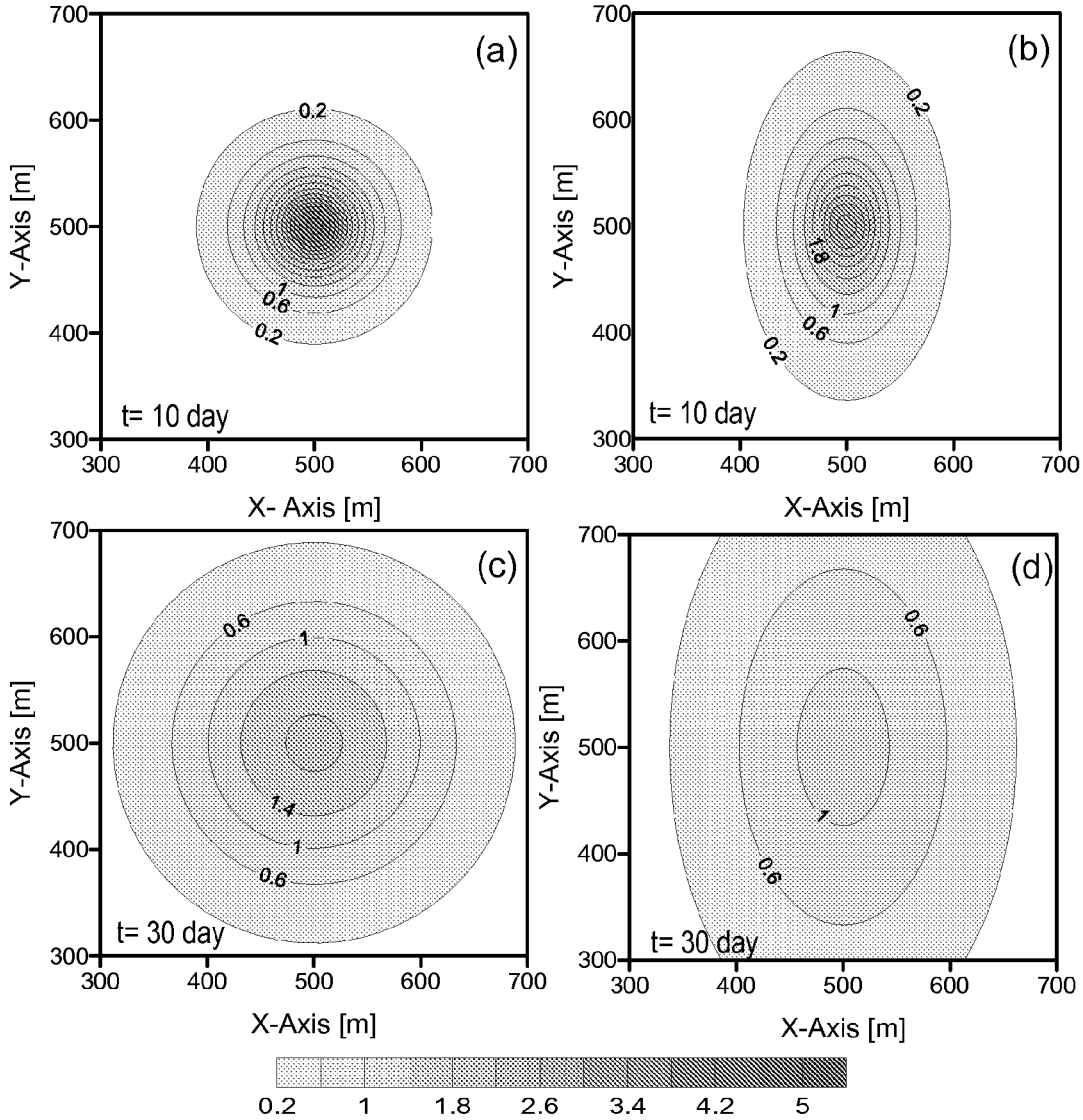
FIG. 2 represents contours of water table variation (in meter) with respect to initial water table height for the recharge rate shown in FIG. 1(*b*), (a) Contours for isotropic aquifer at $10^{th}$ day, (b) contours for anisotropic aquifer at $10^{th}$ day, (c) contours for isotropic aquifer at $30^{th}$ day and (d) contours for anisotropic aquifer at $30^{th}$ day. Boundary conditions are prescribed head at all the boundaries of the aquifer.

FIG. 2 presents contours of water table variation (in meter) with respect to the initial water table height at (a,b) $10^{th}$ day, and (c,d) $30^{th}$ day which correspond to periods of recharging and no recharge, respectively. (a,c) show the case of isotropic aquifer and (b,d) correspond to anisotropic aquifer. In the case of anisotropic aquifer the contour lines are elongated along the Y direction due to the effect of anisotropy in hydraulic conductivity.

Example-2

Figure 3:
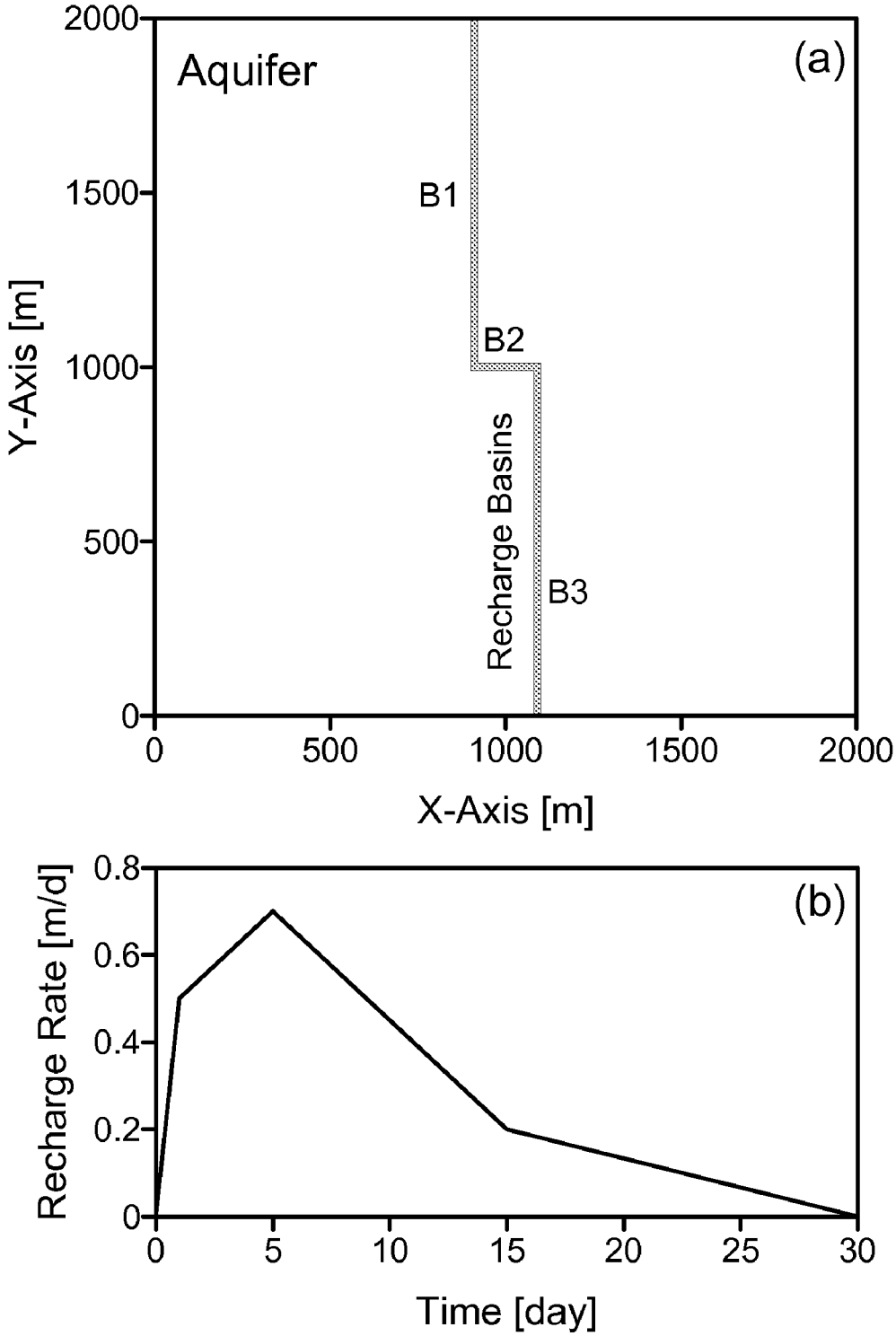
FIG. 3 represents (a) a plan view of an anisotropic unconfined aquifer and three connected recharge basins simulating a long canal and (b) applied time varying rate of recharge.

Second example includes three connected recharge basins (shaded region) to simulate a long canal and zero flux boundary conditions (Case-II). FIG. 3 (a) shows a plan view of the aquifer and recharge basins and FIG. 3 (b) illustrates the nature of recharge rate. The recharge rate is constructed by four sloping linear elements. Here, it is assumed that all the three recharge basins have the same nature of time varying recharge although the digitally implemented method supports different nature of recharge rates for each of these basins. Other input parameters are:

| | | |
|---|---|---|
| Length of aquifer | A | 2000 m |
| Width of aquifer | B | 2000 m |
| Number of Fourier coefficients | m, n | 100 |
| Hydraulic conductivity in X direction | $K_x$ | 4.0 m/d |
| Specific yield | S | 0.2 |
| Initial water table height | $h_0$ | 10 m |
| Anisotropy coefficient | β | 3.0 |
| Lower left corner of recharge basin-1 | $(x_{11}, y_{11})$ | (900, 1010) |
| Upper right corner of recharge basin-1 | $(x_{12}, y_{12})$ | (920, 2000) |
| Lower left corner of recharge basin-2 | $(x_{21}, y_{21})$ | (900, 990) |
| Upper right corner of recharge basin-2 | $(x_{22}, y_{22})$ | (1100, 1010) |
| Lower left corner of recharge basin-3 | $(x_{31}, y_{31})$ | (1080, 0) |
| Upper right corner of recharge basin-3 | $(x_{32}, y_{32})$ | (1100, 990) |

Figure 4:
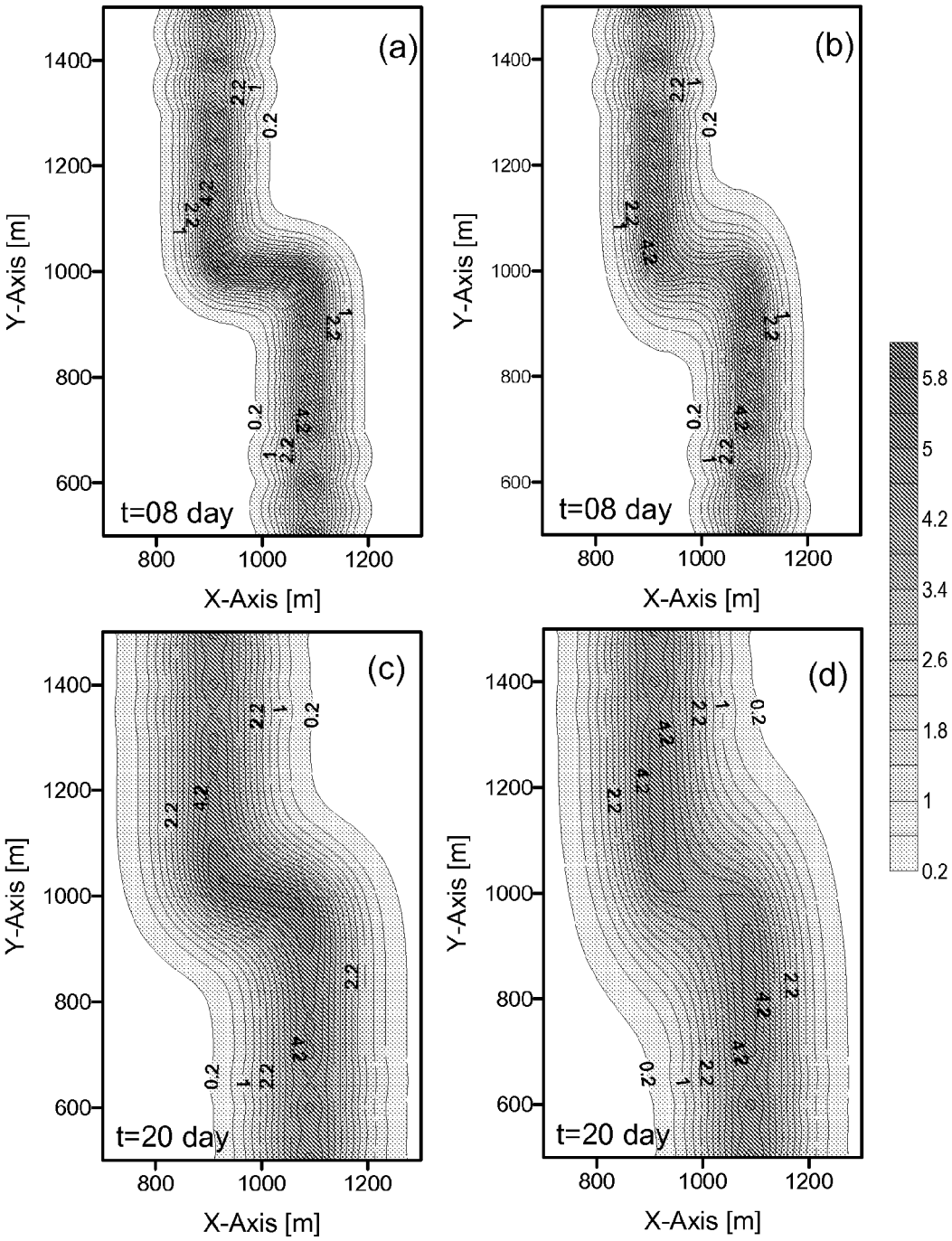
FIG. 4 represents contours of water table variation (in meter) with respect to initial water table height for the recharge rate shown in FIG. 3(*b*), (a) Contours for isotropic aquifer at $8^{th}$ day, (b) contours for anisotropic aquifer at $8^{th}$ day, (c) contours for isotropic aquifer at $20^{th}$ day and (d) contours for anisotropic aquifer at 20th day. Boundary conditions are zero flux at all the boundaries of the aquifer.

FIG. 4 shows contours of water table variation (in meter) at (a,b) $8^{th}$ day, and (c,d) $20^{th}$ day for the above case. (a,c) show water table contours for isotropic aquifer and (b,d) correspond to anisotropic aquifer.

Example-3

Figure 5:
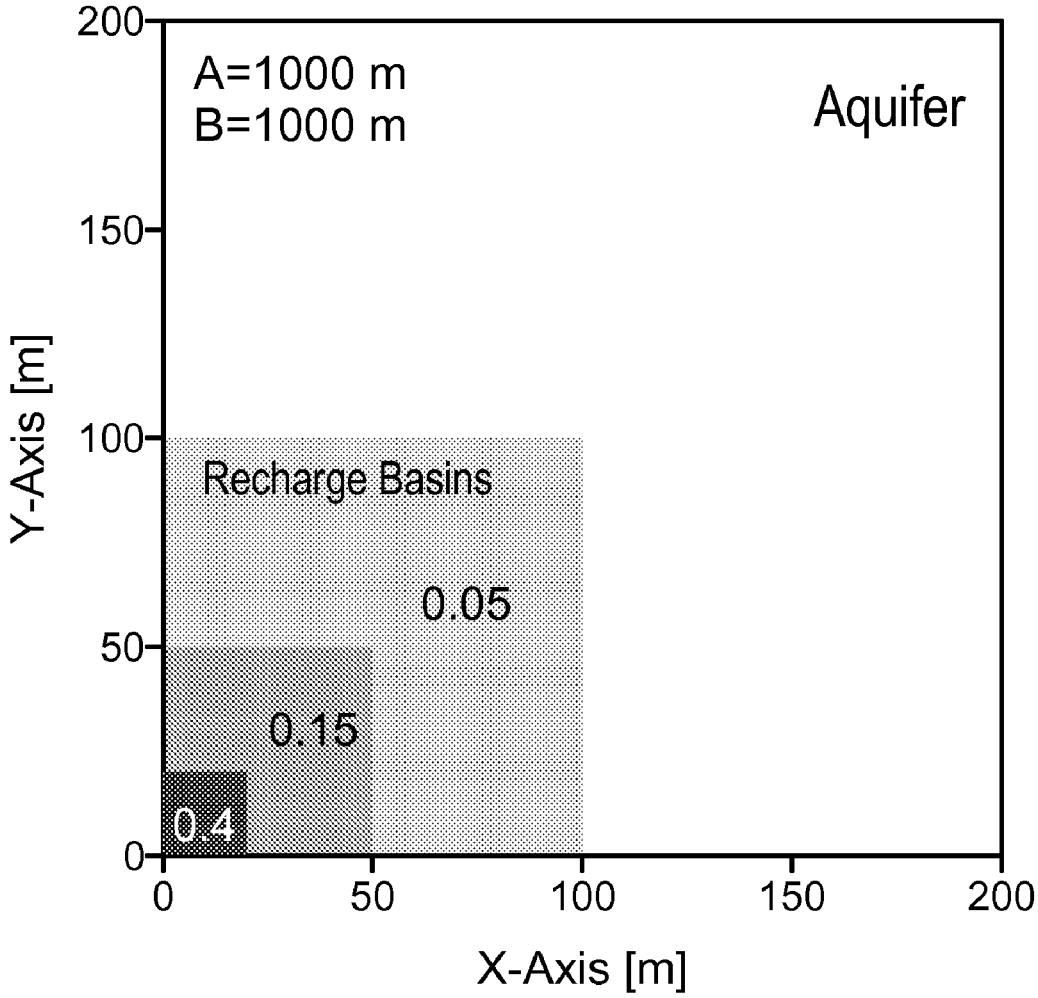
FIG. 5 represents a plan view of anisotropic unconfined aquifer and five recharge basins simulating a large basin having spatially varying recharge rate.

In the above two examples recharge rate varied only with time. No spatial variations in the recharge rate were considered. Third example illustrates an application of the present invention in simulating spatially varying recharge rate. Here, a large recharge basin having spatially varying recharge rate is approximated by five rectangular basins as shown in FIG. 5. Basin 1 has a recharge rate of 0.4 m/d, basins 2 and 3 have recharge rate of 0.15 m/d, and basins 4 and 5 have recharge rate of 0.05 m/d. Constant recharge rate is considered only for simplicity but the present invention supports a more complicated case. Mixed boundary conditions are used for this case. Other input parameters are:

| | | |
|---|---|---|
| Length of aquifer | A | 1000 m |
| Width of aquifer | B | 1000 m |
| Number of Fourier coefficients | m, n | 100 |
| Hydraulic conductivity | $K_x$ | 4.0 m/d |
| Specific yield | S | 0.2 |
| Initial water table height | $h_0$ | 10 m |
| Anisotropy coefficient | β | 3.0 |
| Lower left corner of recharge basin-1 | $(x_{11}, y_{11})$ | (0, 0) |
| Upper right corner of recharge basin-1 | $(x_{12}, y_{12})$ | (20, 20) |
| Lower left corner of recharge basin-2 | $(x_{21}, y_{21})$ | (0, 20) |
| Upper right corner of recharge basin-2 | $(x_{22}, y_{22})$ | (20, 50) |
| Lower left corner of recharge basin-3 | $(x_{31}, y_{31})$ | (20, 0) |
| Upper right corner of recharge basin-3 | $(x_{32}, y_{32})$ | (50, 50) |
| Lower left corner of recharge basin-4 | $(x_{41}, y_{41})$ | (0, 50) |
| Upper right corner of recharge basin-4 | $(x_{42}, y_{42})$ | (50, 100) |
| Lower left corner of recharge basin-5 | $(x_{51}, y_{51})$ | (50, 0) |
| Upper right corner of recharge basin-5 | $(x_{52}, y_{52})$ | (100, 100) |

Figure 6:
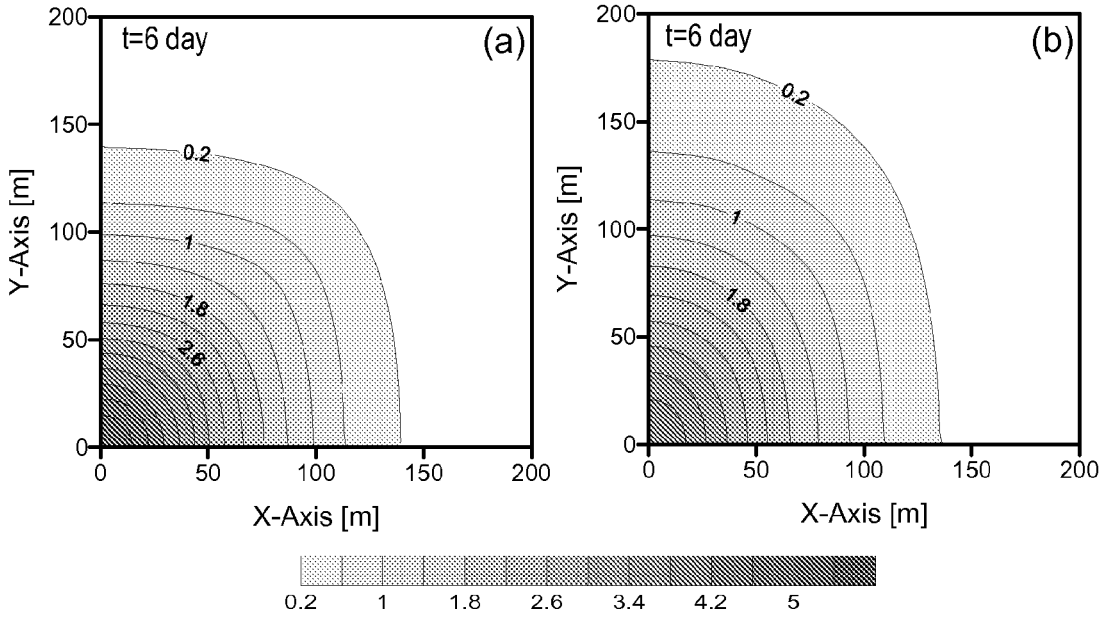
FIG. 6 represents contours of water table variation (in meter) with respect to initial water table height for the recharge rate shown in FIG. 5. (a) Contours of isotropic aquifer at $6^{th}$ day and (b) contours for anisotropic aquifer at $6^{th}$ day. Boundary conditions are mixed prescribed head, zero flux conditions.

FIG. 6 shows contours of water table variation (in meter) corresponding to (a) isotropic and (b) anisotropic aquifers at $6^{th}$ day for this above case. Contours are elongated along Y direction due to the effect of anisotropy.

ADVANTAGES

The main advantages of the present invention are:

1. The analytical method of the present invention helps in accurate estimation of water table fluctuations in an anisotropic unconfined aquifer receiving time varying recharge from multiple rectangular basins.

2. The effect of any general type of recharge rate on water table variation can be analyzed.
3. Each of the recharge basins can have a different pattern of time varying recharge rate.
4. The present invention can be used to simulate groundwater flow due to leakage from a canal or a series of canals.
5. The method can also be used to analyze the effect of spatial variations in the recharge rate on the groundwater flow.
6. The method provides scope for inclusion of the effect of pumping from multiple wells on the water table variations.
7. The method can be used in sensitivity analysis of controlling parameters and validation of numerical schemes.

REFERENCES

Baumann P., 1952. Groundwater movement controlled through spreading. Amer. Soc. Civ. Eng. Trans., 117: 1024-1074.

Dagan G., 1964. Linearized solution of unsteady deep flow towards an array of horizontal drains. J. Geophys. Res., 69: 3381-3389.

Dagan G., 1966. Linearized solutions of free-surface groundwater flow with uniform recharge. Technion Publ. No. 84, Technion, Israel Institute of Technology, Israel.

Glover R. E., 1960. Mathematical derivations as pertain to groundwater recharge. Agric. Res. Serv., USDA, Fort Collins, Collins, Colo., U.S.A.

Hantush M. S., 1967. Growth and decay of groundwater mounds in response to uniform percolation. Water Resour. Res., 3: 227-234.

Hunt B. W., 1971. Vertical recharge of unconfined aquifers. J. Hydraulic Div. ASCE, 97[HY7]: 1017-1030.

Manglik A., Rai S. N., and Singh V. S., 2004. Modeling of aquifer response to time varying recharge and pumping from multiple basins and wells. J. Hydrology, 292: 23-29.

Manglik A., and Rai S. N., 2000. Modeling of water table fluctuations in response to time-varying recharge and withdrawal. Water Resour. Mgmt., 14: 339-347.

Rai S. N., Manglik A., and Singh R. N., 1994. Water table fluctuation in response to transient recharge from a rectangular basin. Water Resour, Mgmt., 8: 1-10.

Rao N. H., and Sarma P. B. S., 1981. Groundwater recharge from rectangular areas. Groundwater, 19: 271-274.

Singh S. R., and Jacob C. M., 1977. Transient analysis of phreatic aquifers lying between two open channels. Water Resour. Res., 13: 411-419.

Warner J. W., Molden D., Chehata M., and Sunada D. K., 1989. Mathematical analysis of artificial recharge from basin. Water Resour. Bull., 25: 401-411.

Zomorodi K., 1991. Evaluation of response of a water table to a variable recharge rate. Hydrol. Sci. J., 36: 67-78.

The invention claimed is:

1. A processor-based method of predicting the dynamic behavior of water table in a two-dimensional anisotropic unconfined aquifer having a general time-varying recharge rate from multiple rectangular recharge basins, the said method comprising the steps of:

a. obtaining data relating to the two-dimensional unconfined aquifer and data describing flow of ground water in the unconfined aquifer;

b. obtaining data describing the conditions existing at the boundaries of the two-dimensional aquifer, location and dimensions of at least one rectangular recharge basin located within the aquifer;

c. calculating rate of recharge (P) for at least one or more of the said recharge basins using the processor wherein the rate of recharge is calculated as a general time and/or space varying recharge function;

d. describing the groundwater flow in the two-dimensional anisotropic unconfined aquifer, based on steps (a), (b) and (c), in the form of second order diffusion equations; and e. digitally implementing a solution to the above system of equations by using finite Fourier Transform method thereby predicting the dynamic behavior of water table in two-dimensional anisotropic unconfined aquifer, wherein visualization of the transformed data is output from the processor.

2. A method according to claim 1, wherein in step (c), the rate of recharge (P) is defined as:

$$P(x, y, t) = \sum_{i=1}^{N} p_i(t)[H_a(x - x_{i1}) - H_a(x - x_{i2})] \cdot [H_a(y - y_{i1}) - H_a(y - y_{i2})],$$

wherein, $p_i(t)$=recharge rate of $i^{th}$ basin, N=total number of basins, Ha(x)=unit step function, $(x_{i1}, y_{i1})$ and $(x_{i2}, y_{i2})$ are coordinates of the lower left and upper right corners of the $i^{th}$ basin, respectively, $p_i(t)$ is approximated by a series of line elements given by:

$$p_i(t) = \begin{cases} r_{ij}t + c_{ij}, & t_{ij} \le t \le t_{i,j+1} \\ r_{ik}t + c_{ik}, & t \ge t_k \end{cases}$$

wherein $r_{ij}$ is a slope and $c_{ij}$ is an intercept of the $j^{th}$ linear element of the $i^{th}$ basin.

3. A method according to claim 1, wherein in step (d), the groundwater flow in the two-dimensional anisotropic unconfined aquifer is defined in the form of an equation as:

$$\frac{\partial^2 H}{\partial x^2} + \beta\frac{\partial^2 H}{\partial y^2} + \frac{2}{K_x}P(x, y, t) = \frac{1}{a}\frac{\partial H}{\partial t}$$

Wherein, $H=h^2-h_o^2$ $a=K_s\bar{h}/s$ $\beta$=coefficient of anisotropy ($K_y/K_x$)

h=variable water table height $h_o$=initial water table height $\bar{h}$=weight mean of the depth of saturation $K_x$=hydraulic conductivity in X direction $K_y$=Hydraulic conductivity in Y direction S=Specific yield P=Recharge rate $(x_{i1}, y_{i1})$=lower left corner of $i^{th}$ recharge basin $(x_{i2}, y_{i2})$=upper right corner of $i^{th}$ recharge basin A=Length of aquifer B=width of aquifer N=Number of recharge basin $P_i(t)$=recharge rate of $i^{th}$ basin $H_a(x)$=Unit step function m & n=number of Fourier coefficient r=Slope c=Intercept t=time.

4. A method according to claim 1 wherein, the aquifer is a porous medium having anisotropic hydraulic conductivity.

5. A method according to claim 1 wherein, the coefficient of anisotropy is taken as the ratio of hydraulic conductivities along Y and X directions.

6. A method according to claim 1, wherein different combinations of prescribed head and zero flux conditions at the boundaries of the two-dimensional aquifer are considered.

7. A method according to claim 1, wherein all the rectangular recharge basins can be arbitrarily located within the aquifer.

8. A method according to claim 1, wherein general time-varying rate of recharge is represented by a series of linear elements closely approximating the actual rate of recharge.

9. A method according to claim 1, wherein each recharge basin can have different time-varying rate of recharge and/or can be constructed to have spatially heterogeneous recharge.

10. A method according to claim 1, wherein the analytical solution is obtained by using a two-dimensional finite Fourier-transform method.

* * * * *